US006693248B1

(12) United States Patent
Schultz

(10) Patent No.: US 6,693,248 B1
(45) Date of Patent: Feb. 17, 2004

(54) METHODS AND APPARATUS FOR TRANSFERRING ELECTRICAL POWER

(75) Inventor: Ronald Lloyd Schultz, Northfield, IL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/065,536

(22) Filed: Oct. 28, 2002

(51) Int. Cl.[7] ..... H01H 83/00
(52) U.S. Cl. ..... 200/11 TC; 200/1 R; 200/17 R
(58) Field of Search ..... 200/11 TC, 1 R, 200/17 R, 18, 50 C, 50 A, 324, 323, 327, 400

(56) References Cited

U.S. PATENT DOCUMENTS 4,025,739 A * 5/1977 Kull ..... 200/38 F
4,518,832 A * 5/1985 Geremia ..... 200/4
4,804,933 A * 2/1989 Becker et al. ..... 335/186
5,023,469 A * 6/1991 Bassett et al. ..... 307/64
5,436,415 A * 7/1995 Smith et al. ..... 200/50.35
5,576,604 A 11/1996 Kunert et al.
5,581,133 A 12/1996 Smith et al.
5,638,948 A 6/1997 Sharaf et al.
5,748,432 A 5/1998 Przywozny et al.
5,773,983 A 6/1998 Cochran et al.
5,784,240 A 7/1998 Przywozny
5,914,467 A 6/1999 Jonas et al.
5,931,299 A * 8/1999 Hsieh ..... 206/376
5,942,901 A 8/1999 Cochran et al.
6,172,432 B1 1/2001 Schnackenberg et al.
6,208,130 B1 3/2001 Cochran et al.
6,218,921 B1 * 4/2001 Eberts et al. ..... 335/176
6,297,640 B1 10/2001 Hayes

* cited by examiner

*Primary Examiner*—Michael Friedhofer
*Assistant Examiner*—K. Lee
(74) *Attorney, Agent, or Firm*—Karl A. Vick, Esq.; Armstrong Teasdale LLP

(57) ABSTRACT

A transfer switch includes a cam including a first groove and a second groove different from the first groove, a follower apparatus positioned in the second groove, and a driver apparatus positioned in the first groove, the driver apparatus configured to rotate the cam in only a first direction.

26 Claims, 6 Drawing Sheets

METHODS AND APPARATUS FOR TRANSFERRING ELECTRICAL POWER

BACKGROUND OF INVENTION

This invention relates generally to electrical power transfer and, more particularly, to electrical power transfer switches and emergency lighting bus switches.

Many applications use transfer switches to switch between power sources supplying power to the application. For example, transfer switches may switch power supply from a primary power source to an alternate or backup power source. Critical equipment and businesses, such as hospitals, airport radar towers, and high volume data centers are dependent upon transfer switches to provide continuous power. More specifically, in the event that power is lost from a primary source, the transfer switch shifts the load from the primary source to the alternate source in a minimal amount of time to facilitate providing continuous electrical power to such equipment and businesses.

At least one known transfer switch utilizes a make-before-break switch to transfer the load from the primary source to the alternate source. The make-before-break switch includes dual main contacts which require dual shafts and a plurality of actuators. Transfer switches including dual main contacts and dual shafts may also include dual solenoids to drive the shafts. However, because of the redundancy, in the event one of the solenoids fails, the main contacts may remain in an undesired position thereby preventing the transfer switch from activating to enable the business to switch to an alternate power supply.

Other known transfer switches utilize a single solenoid to drive two position switches. As such, during operation the single solenoid may stall in a top dead center position, and accordingly, such switches are therefore sensitive to timing and cutoff of the solenoid current at the optimum time.

SUMMARY OF INVENTION

In one aspect, a transfer switch is provided. The transfer switch includes a cam including a first groove and a second groove different from the first groove, a follower apparatus positioned in the second groove, and a driver apparatus positioned in the first groove, the driver apparatus configured to rotate the cam in only a first direction.

In another aspect, a method for manufacturing a transfer switch is provided. The method includes providing a transfer switch including a cam including a first groove and a second groove different from the first groove, operationally coupling a follower apparatus in the second groove, and operationally coupling a driver apparatus in the first groove, such that the driver apparatus is configured to rotate the cam in only a first direction.

DETAILED DESCRIPTION

Figure 1:
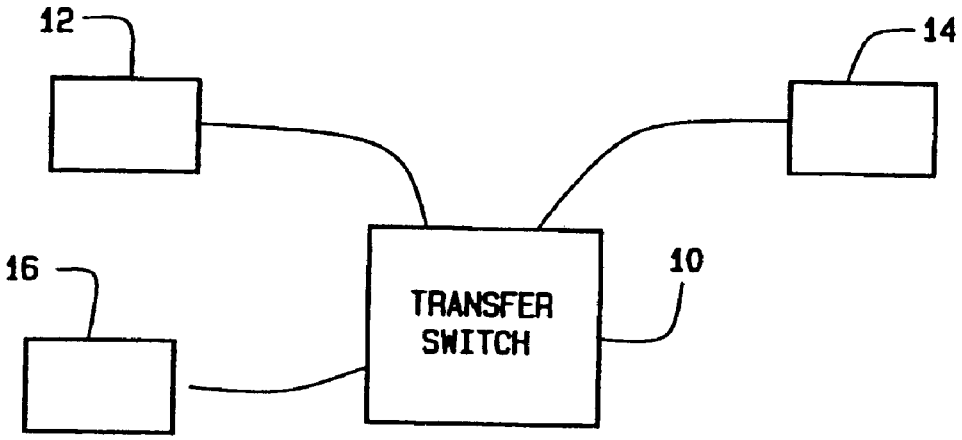
FIG. 1 is a diagram of a power system including a transfer switch.

FIG. 1 illustrates a power system 8 which includes a transfer switch 10 used to selectively switch between a plurality of power sources, e.g. between a power source 12 and a power source 14, to supply electrical power to a load 16. For example, in one embodiment, load 16 is a hospital, airport radar tower or other electrical power user that desires a substantially uninterrupted power supply. Load 16, via switch 10, draws power from source 12 under normal operating conditions. If, for example, power source 12 fails or becomes inadequate to supply power to load 16, load 16 is transferred via switch 10 to draw power from source 14. When source 12 again provides sufficient power, load 16 may be transferred via switch 10 to resume drawing power from source 12. In another embodiment, transfer switch 10 is a lighting bus switch, e.g., between a lighting load 12, a second lighting load such as back-up or emergency lighting and a power source 16. The foregoing descriptions of transfer switch 10 operation is exemplary only, and additional functions may be performed by transfer switch 10.

A second mode of operation can be incorporated. That is, a delay (time) between source connections. For those loads comprising large motors, the cut-off of power to the motors while switching permits the motors, which are still spinning, to generate a back EMF (voltage). It is desirable to wait for a period of time to permit this back EMF to decay before connecting to this alternating source, thereby insuring that no opposing voltages would trip breakers and compromise the effectiveness of having a second source. This mode of transfer or delayed transfer, would entail that the second follower be stopped at this acme of its groove. A first groove would be cut to have this solenoid effect two strokes to achieve the interrupted travel.

Figure 2:
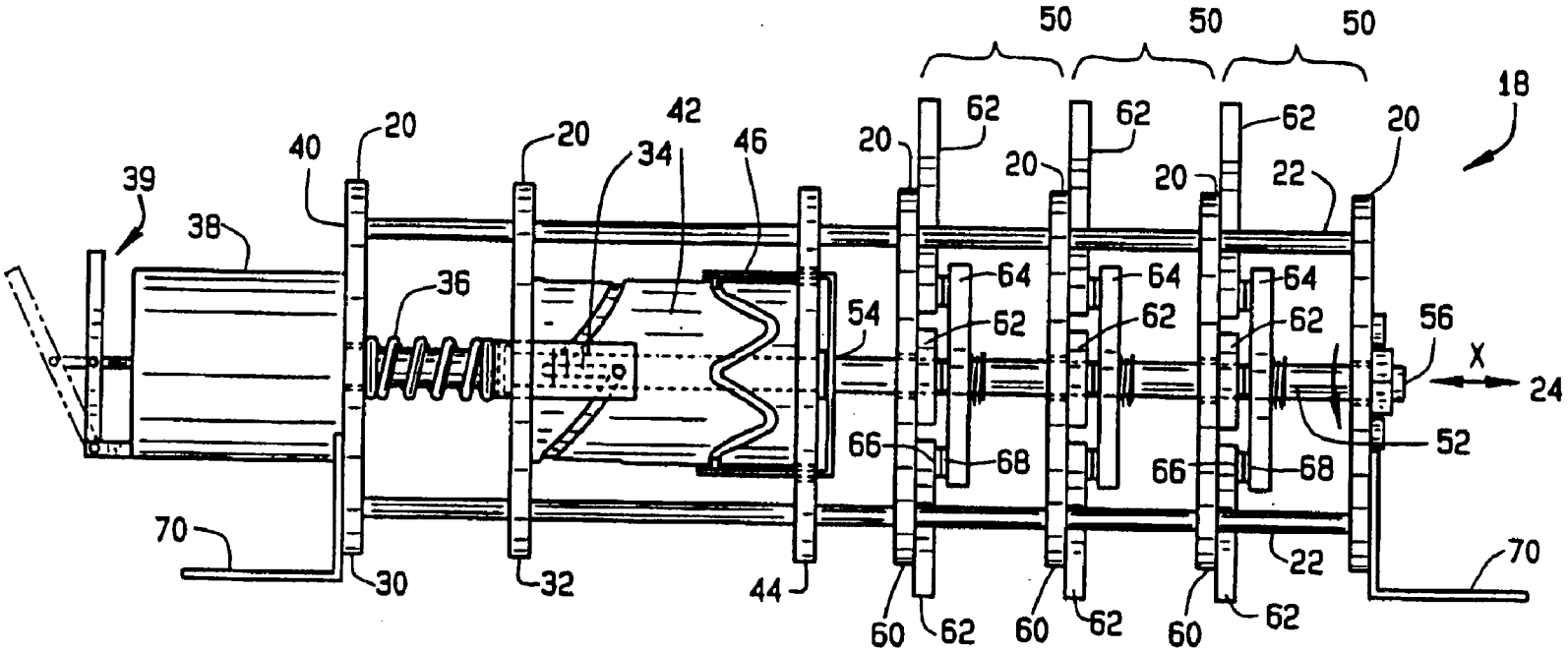
FIG. 2 is an illustration of one embodiment of a transfer switch that may be used with the power system shown in FIG. 1.

FIG. 2 illustrates a side view of a transfer switch 18 that may be used with power system 8 (shown in FIG. 1). In an exemplary embodiment, transfer switch 18 includes a plurality of circular support structures 20, that are sized approximately equally and are mechanically coupled together using a plurality of mechanical fasteners 22. In one embodiment, mechanical fasteners 22 extend through, and are mechanically coupled to, support structures 20 such that support structures 20 are maintained in an approximately fixed position along an axis of symmetry 24. In another embodiment, transfer switch 18 includes a plurality of support structures 20 coupled together using an outer cover (not shown) rather than mechanical fasteners 22. Although support structures 20 are shown as circular in the one embodiment, support structures 20 can be fabricated in any desired shape, for example, triangular, rectangular, hexagonal, and octagonal.

In an exemplary embodiment, transfer switch 18 includes a first support structure 30, a second support structure 32, a driver apparatus 34 extending through second support structure 32, and a spring 36 positioned between driver apparatus 34 and first support structure 30. In one embodiment, a solenoid 38 is mechanically coupled to a first side 40 of first support structure 30. In one embodiment, solenoid 38 is a push-pull solenoid and includes a plunger (not shown) mechanically coupled to driver apparatus 34 through spring 36. In another embodiment, transfer switch 18 is activated using a mechanical attachment (not shown) rather than solenoid 38. A manually operated handle 39 functions as a backup to solenoid 38 in the event solenoid 38 is non-operational. The manually operated handle 39 does not move with solenoid actuation. In another embodiment, the solenoid 38 has no manually operated handle 39.

Transfer switch 18 also includes, a cam 42 positioned between second support structure 32 and a third support structure 44, and a follower apparatus 46 that extends through third support structure 44 to mechanically couple to cam 42. Transfer switch 18 also includes a plurality of electrical contact compartments 50, and a shaft 52 that extends through electrical contact compartments 50. In the exemplary embodiment, three electrical contacts compartments 50 are shown, although transfer switch 18 may include any quantity of electrical contact compartments 50 as selected by the manufacturer. Each electrical contact compartment 50 includes a support structure 60 and plurality of electrical contacts 62 coupled to support structure 60. Support structures 60 are maintained in an approximately fixed position along an x-axis 24 using mechanical fasteners 22, such that support structures 60 are mechanically coupled to mechanical fasteners 22. Electrical contact compartment 50 also includes a plurality of rotatable contacts 64 mechanically coupled to shaft 52 and spring loaded to assure contact forces during the life of the contacts after erosion and configured to electrically couple to electrical stationary contacts 62. Electrical contacts 62 and rotatable contacts 64 each include a plurality of contact pads 66 and 68 respectively. In one embodiment, support structures 60 are fabricated using an insulative material that does not conduct electricity. In another embodiment, support structures 60 are fabricated from a metallic material, and transfer switch 18 includes an electrical insulator (not shown) positioned between support structures 60 and electrical contacts 62. Transfer switch 18 also includes a plurality of mounting apparatuses 70 mechanically coupled to transfer switch 18 and configured to secure transfer switch 18 in a fixed position.

Figure 3:
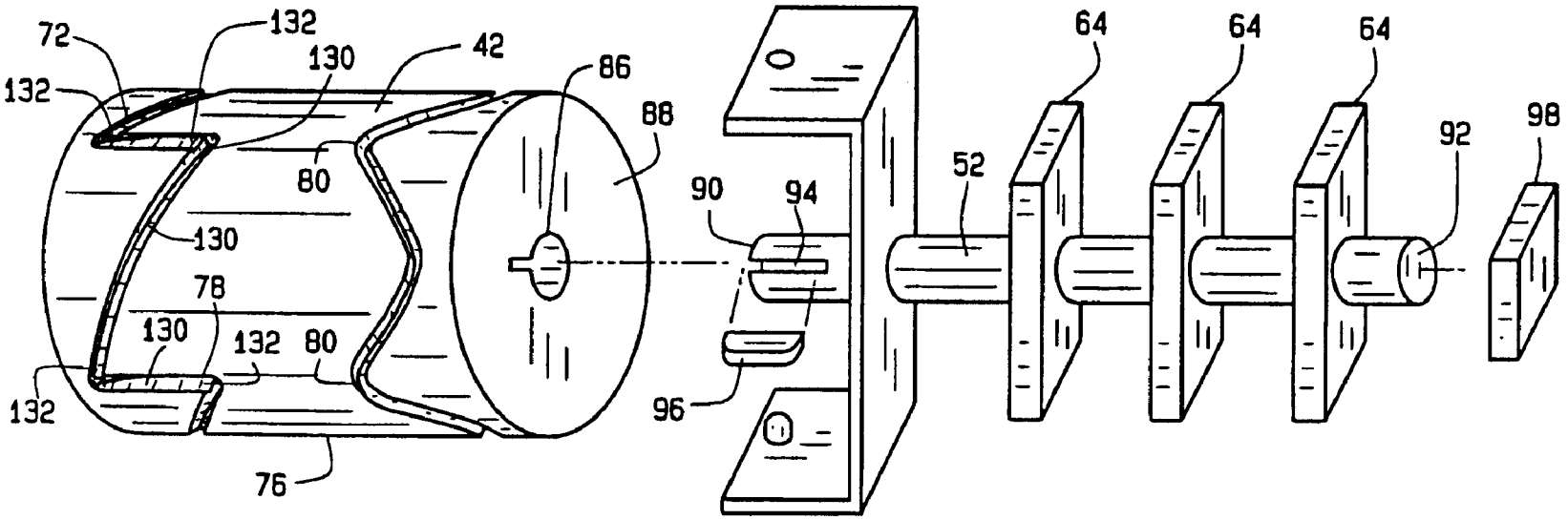
FIG. 3 an explode view of a portion of the transfer switch shown in FIG. 2.
Figure 4:
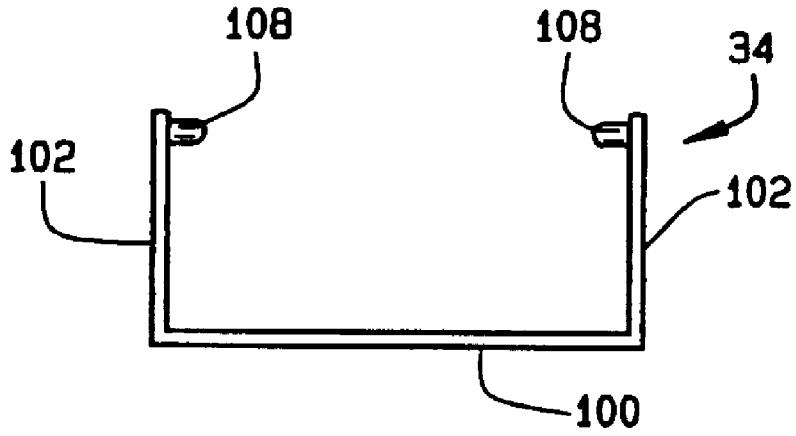
FIG. 4 is a perspective view of a portion of the transfer switch shown in FIG. 2.
Figure 5:
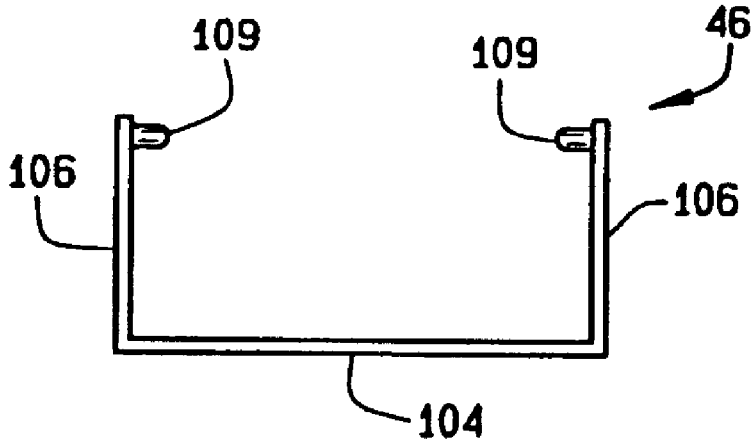
FIG. 5 is a perspective view of a portion of the transfer switch in FIG. 2.

FIG. 3 is a perspective view of cam 42 and shaft 52. FIG. 4 is a side view of driver 34. FIG. 5 is a side view of follower 46. In the exemplary embodiment, driver 34 and follower 46 are substantially similar in design although they perform different functions as described later herein. More specifically, cam 42 is substantially cylindrically-shaped, and includes a first groove 72 and a second groove 74 machined into a surface 76 of cam 42. First groove 72 is substantially z-shaped, and second groove 74 is substantially sinusoidal shaped. First groove 72 and second groove 74 are each continuous and extend circumferentially around surface 76 of cam 42. First groove 72 includes a first quantity of nodes 78, and second groove 74 includes a second quantity of nodes 80 equivalent to first quantity of nodes 78. In the exemplary embodiment, first quantity of nodes 78 is equal to second quantity of nodes 80 such that first quantity of nodes 78 are mirrored by second quantity of nodes 80. Alternatively, first quantity of nodes 78 is not equal to second quantity of nodes 80 such that first quantity of nodes 78 are not mirrored by second quantity of nodes. For example, if a set of electrical contacts 62 are not connected to a source or a load, transfer switch 18 may include a first quantity of nodes and a second quantity of nodes, equal to two times the first quantity of nodes, such that activation of the transfer then rotates rotatable contacts 64 past a first set of electrical contacts to a second set of electrical contacts.

Cam 42 includes an opening 86 positioned in a second end 88 of cam 42. Shaft 52 is mechanically coupled to cam 42 and includes a first end 90 and a second end 92. First end 90 includes a slot 94 and a keyway 96 positioned within slot 94. In the exemplary embodiment, shaft 52 is shaped substantially similar to opening 86 such that shaft 52 is slidably coupled to cam 42. Accordingly, when a rotational force is applied to cam 42, the force is transferred through cam 42 to shaft 52 using keyway 96, thereby causing subsequent rotation of shaft 52, while still allowing shaft 52 to slide axially inside cam 42. In the exemplary embodiment, keyway 96 has been described to facilitate mechanically coupling shaft 52 to cam 42. In another embodiment, a plurality of mechanical fasteners are used, such as, but not limited to, a cotter pin, and a bolt, etc. Transfer switch 18 also includes an indicator 98 mechanically coupled to second end 92. In an alternative embodiment, indicator 98, such as but not limited to limit switches and hall effect sensors, is formed unitarily with shaft 52.

Driver 34 includes an end 100, and two sides 102 that are substantially perpendicular to end 100. Follower 46 includes an end 104, and two sides 106 that are substantially perpendicular to end 104. Driver 34 and follower 46 each include a plurality of pins 108 and 109 respectively that are mechanically coupled to driver 34 and follower 46, respectively. Pins 106 and 108 are spring-loaded to pass over surface 84 and mechanically engage grooves 72 and 74 respectively. Follower 46 and electrical contacts 64 are mechanically coupled to shaft 52, and driver 34 is mechanically coupled to solenoid 38 (shown in FIG. 1).

Figure 6:
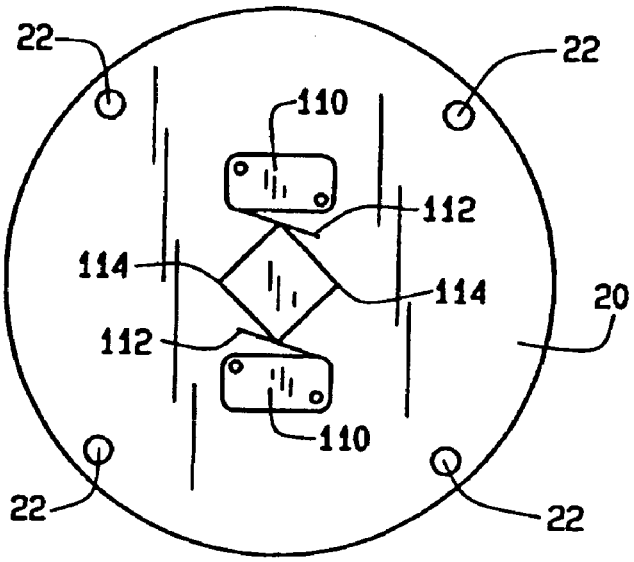
FIG. 6 is an end view of the transfer switch shown in FIG. 2.

FIG. 6 is an end view of transfer switch 18 including a plurality of electrical switches 110 mechanically coupled to support structure 20. In the exemplary embodiment, electrical switches 110 are limit switches and each includes an arm 112 slidably coupled to shaft 52. Accordingly, as shaft 52 rotates, arms 112 are alternately opened and closed by an edge 114 of indicator 98, thereby alternately energizing and de-energizing switches 110. Indicator 98 includes a plurality of edges 114 equivalent to a quantity of nodes 78 and 80. For example, if first groove 72 and second groove 74 each include four nodes 78 and 80, respectively, indicator 114 includes four edges. Alternatively, transfer switch 18 can include any desired quantity of nodes 78 and 80 and an equal quantity of edges 114. In the exemplary embodiment, switches 110 are configured to provide an electrical signal to solenoid 38 when shaft 52 has rotated to a desired position, thereby de-energizing solenoid 38. Additionally, switches 110 are configured to provide an electrical signal indicative of a rotational position of shaft 52 and therefore rotatable contacts 64 to external control devices or indicating panels.

Figure 7:
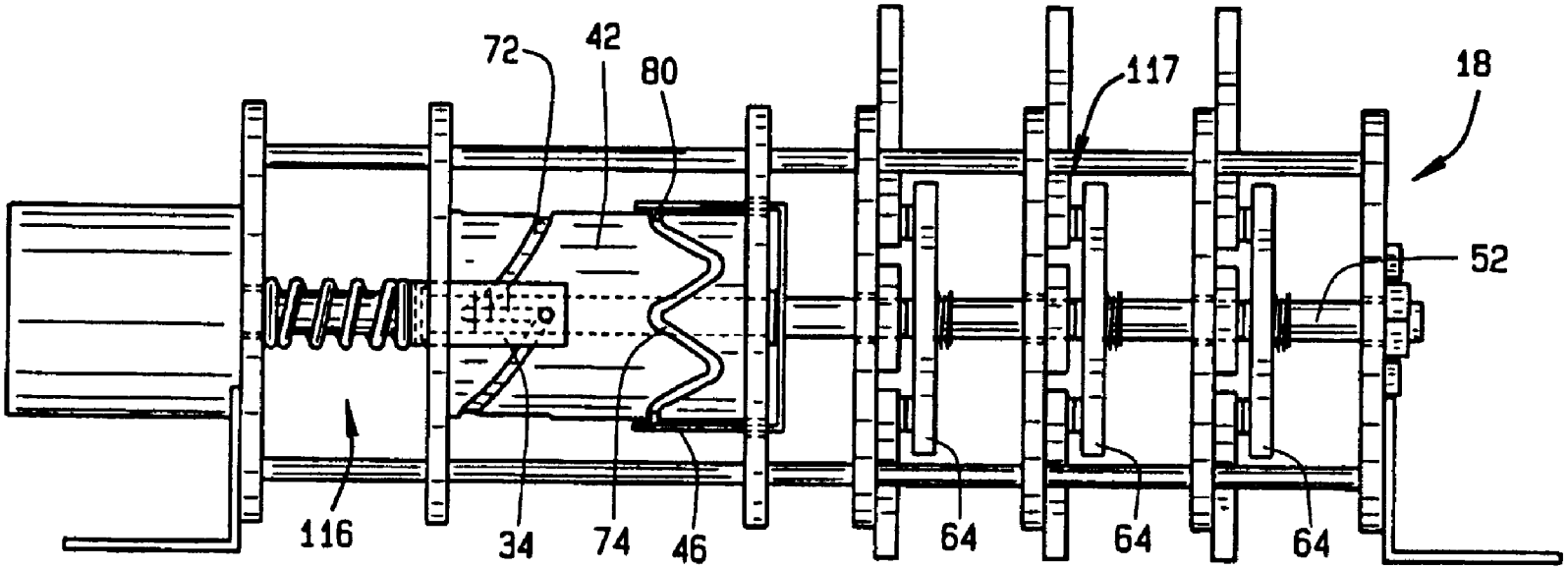
FIG. 7 is a perspective view of the transfer switch shown in FIG. 2 is a de-energized position.

FIG. 7 is a perspective view of transfer switch 18 in a de-energized position 116, i.e. solenoid 38 is not energized. In de-energized position 116, two driver pins 108 are positioned within groove 72, and spring 36 biases driver 34 in an uppermost position, i.e., at node 78. Further, two follower pins 109 are positioned in groove 74 to maintain follower apparatus 46 at an uppermost position, i.e. at node 80, thereby maintaining follower apparatus 46 and therefore electrical contacts 64 in a closed position 117. A ledge 132 (shown in detail in FIG. 3) cut into the uppermost groove of 78 at point 132 allows the spring loaded pin to fall and prevent return of the pin. The pin must proceed down incline 130 forcing the cam to turn.

Figure 8:
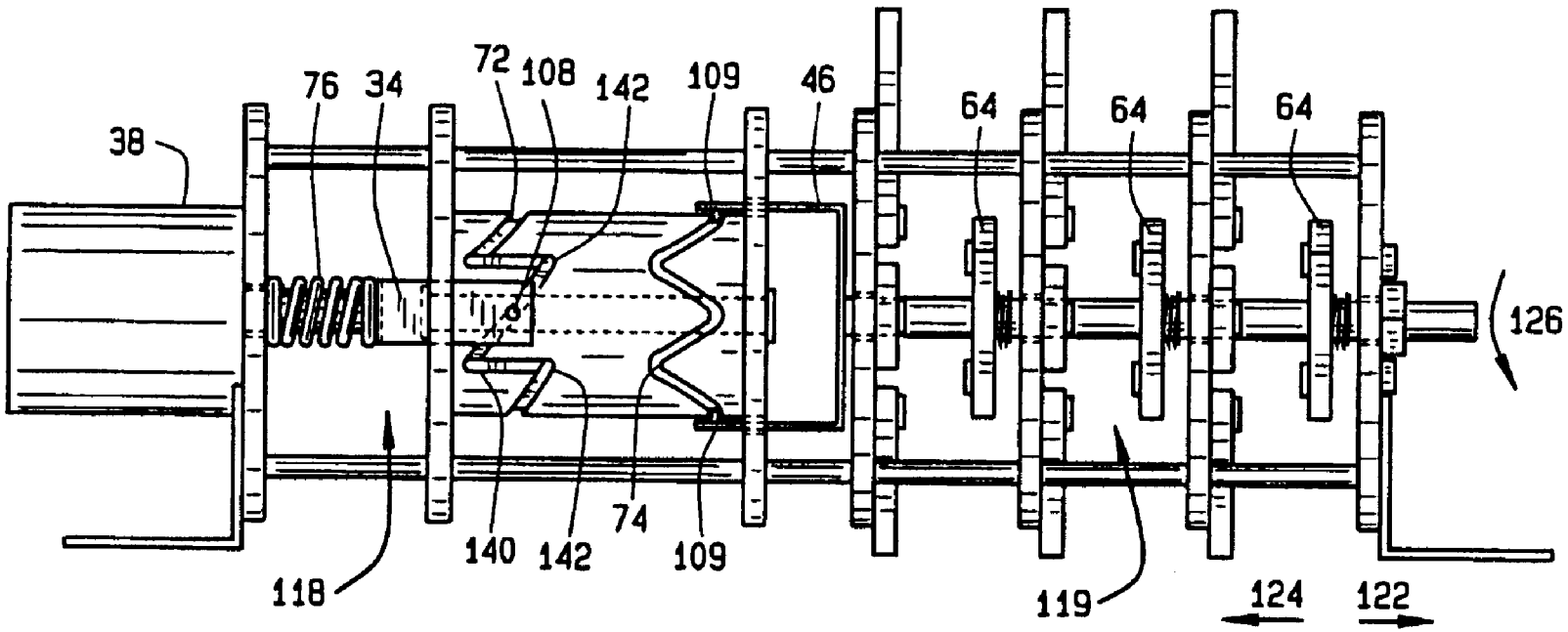
FIG. 8 is a perspective view of the transfer switch shown in FIG. 2 is an energized position.

FIG. 8 is a perspective view of transfer switch 18 in an energized position 118, i.e. solenoid 38 is energized and rotatable contacts 64 are fully extended, i.e., in an open position 119. In use, solenoid 34, mechanically coupled to driver apparatus 34, is energized, thereby retracting driver apparatus 34 towards solenoid 38 and compressing spring 36. As driver apparatus 34 is retracted toward solenoid 38, driver pins 108 positioned in groove 72 causes cam 42 to rotate in a first rotational direction 120. Cam 42 rotating in first rotational direction 120 facilitates moving follower 46, using follower pins 109, along sinusoidal groove 74. Accordingly, follower 46 mechanically coupled to shaft 52 and rotatable contacts 64 move in an approximately sinusoidal and along a first axial direction 122, thereby positioning rotatable contacts 64 in open position 119. For example, follower pins 109 cause shaft 52 to move in first axial direction 122 and first rotational direction 120 simultaneously, thereby moving rotatable contacts 64 approximately 45 degrees along a sinusoidal path to open position 119 as shown in FIG. 8. As cam 42 continues to rotate in first rotational direction 120, follower pins 109 cause shaft 52 to move in a second axial direction 124, opposite from first axial direction 122, thereby moving shaft 52 in second axial direction 124 and simultaneously moving rotatable contacts 64 approximately 45 degrees along the sinusoidal path to closed position 117 as shown in FIG. 9. In the exemplary embodiment, groove 72 includes a plurality of tapered portions 130, and a ledge 132 positioned at each node of each tapered portion 130 (shown in FIG. 3). When driver apparatus 34 has reached a node 78, or a ledge 132 in groove 72, spring-loaded driver pins 108 fully extend into ledge 132, thereby facilitating moving driver apparatus 34 in only first rotational direction 120. Pins 108, 109 on driver 34 are spring loaded to enable riding the inclined ramp of cam 42, fall off ledge 132 and not be permitted to return, thereby being unidirectional. Once driver apparatus 34 has reached a bottom node 140 and rotatable contacts are in fully closed position 117, indicator 98 activates at least one of limit switches 110, thereby deactivating solenoid 38. As solenoid 38 is deactivated, spring 36 facilitates moving driver apparatus 34 to a top node 142.

Transfer switch 18 facilitates transferring load 16 from source 12 to source 14, in phase, and without a loss of power to load 16. Furthermore, transfer switch 18, operating in electrical systems 10 which utilizes approximately 150 amperes, uses a single solenoid 38, a single cam 42, and a single shaft 52 for articulating rotatable contacts 64, i.e. bridging contact array, and connecting either of two sources 12 and 14 to load 16. Further, transfer switch 18 operates in an open or a delayed transition mode, since rotatable contacts 64 are made to traverse a sinusoidal curved path in transiting between stationary contacts 62. Additionally, a length of the two gaps imposed by the path of the rotatable contacts 64 facilitates eliminating the need for are extinguishing grids.

Cam 42 also mechanically locks shaft 52, and rotatable contacts 64 into an engaged or for the case of the delayed model, into open position 119, i.e., a position midway between electrical contacts 62. Transfer switch 18 is not influenced by gravity and therefore can be used in any position. Further, the arrangement and presentation of the electrical contacts 62, i.e. cable terminating lugs, facilitates ease of installation and maintenance. Additionally, the radial placement of the stationary buses and electrical contacts 62 facilitate providing an increased dielectric separation while maintaining compactness.

Transfer switch 18 also facilitates manual operation by using a handle to engage a solenoid plunger extension and levering solenoid 38 to its end position. Further, solenoid 38 can be easily accessed and changed in the field without affecting the contact engagement or disturbing any current flow in progress. Additionally, transfer switch 18 utilizes a reduce quantity of parts compared to other known transfer switches, and a plurality of cams 42, including grooves 72 and 74 can be utilized to affect open or delayed transition modes.

In use, transfer switch 18 can be utilized as a transfer switch of multipole configuration, and as a specialty lighting contactor for transferring power to an emergency bus for reduced power consumption.

Exemplary embodiments of a transfer switch are described above in detail. The transfer switch is not limited to the specific embodiments described herein, but rather, components of each assembly may be utilized independently and separately from other components described herein. Each transfer switch component can also be used in combination with other transfer switch components.

While the invention has been described in terms of various specific embodiments, those skilled in the art will recognize that the invention can be practiced with modification within the spirit and scope of the claims.

What is claimed is:

1. A transfer switch comprising:

a cam body comprising a first groove, a second groove that is different from the first groove, and an axis of symmetry, said first groove and said second groove circumscribing said axis of symmetry;

a follower apparatus positioned in said second groove; and a driver apparatus positioned in said first groove, said driver apparatus configured to rotate said cam in only a first direction.

2. A transfer switch in accordance with claim 1 further comprising a solenoid mechanically coupled to said driver apparatus, said solenoid configured to move said driver apparatus along said axis of symmetry.

3. A transfer switch in accordance with claim 1 wherein said first groove comprises a substantially z-shaped groove and said second groove comprises a substantially sinusoidal shaped groove.

4. A transfer switch in accordance with claim 1 wherein said first groove comprises a first quantity of nodes and said second groove comprises a second quantity of nodes equivalent to said first quantity of nodes and said second quantity of nodes.

5. A transfer switch in accordance with claim 4 further comprising a shaft mechanically coupled to said follower apparatus, said shaft comprising an indicator comprising a first quantity of edges equal to said first quantity of nodes.

6. A transfer switch in accordance with claim 5 further comprising a plurality of rotatable electric contacts mechanically coupled to said shaft and configured to rotate in only a first direction along an approximately sinusoidal path.

7. A transfer switch in accordance with claim 6 further comprising a first quantity of paired electrical connections comprising a first electrical connection and a second electrical connection, said rotatable electric contacts configured to electrically couple said first electrical connection to said second electrical connection.

8. A transfer switch in accordance with claim 7 wherein said first quantity of paired electrical connections is equivalent to said first quantity of nodes and said second quantity of nodes.

9. A transfer switch in accordance with claim 1 wherein said first groove comprises a plurality of inclines and a recess positioned at an end of said inclines.

10. A transfer switch in accordance with claim 9 wherein said recess is configured to rotate said cam in only a first direction.

11. A transfer switch in accordance with claim 1 further comprising a limit switch, said limit switch configured to output a signal comprising at least one of an indication of a shaft position and an electrical output to a solenoid.

12. A transfer switch in accordance with claim 1 wherein said driver apparatus and said follower apparatus are offset by approximately ninety degrees.

13. A transfer switch comprising:

a cam comprising:

a substantially z-shaped groove comprising a first quantity of nodes; and a substantially sinusoidal shaped groove comprising a second quantity of nodes equivalent to said first quantity of nodes and said second quantity of nodes;

a follower apparatus positioned in said substantially sinusoidal shaped groove; and a driver apparatus positioned in said substantially z-shaped groove, said driver apparatus configured to rotate said cam in only a first direction.

14. A method for manufacturing a transfer switch, said method comprising:

providing a transfer switch, the transfer switch including a cam including a first groove and a second groove different from the first groove, and an axis of symmetry, wherein the first groove and the second groove circumscribe the axis of symmetry;

operationally coupling a follower apparatus in the second groove; and operationally coupling a driver apparatus in the first groove, such that the driver apparatus is configured to rotate the cam in only a first direction.

15. A method for manufacturing a transfer switch in accordance with claim 14 further comprising operationally coupling a solenoid to the driver apparatus such that the driver apparatus is configured to move along the axis of symmetry.

16. A method for manufacturing a transfer switch in accordance with claim 14 wherein said providing a transfer switch including a cam including a first groove and a second groove different from the first groove comprises providing a cam including a substantially z-shaped groove and a substantially sinusoidal shaped groove.

17. A method for manufacturing a transfer switch in accordance with claim 14 wherein said operationally coupling a follower apparatus in the second groove and operationally coupling a driver apparatus in the first groove comprises operationally coupling a follower apparatus in the second groove including a first quantity of nodes and operationally coupling a driver apparatus in the first groove including a second quantity of nodes equivalent to the first quantity of nodes.

18. A method for manufacturing a transfer switch in accordance with claim 17 further comprising mechanically coupling a shaft to the follower apparatus, the shaft including an indicator including a first quantity of edges equal to the first quantity of nodes.

19. A method for manufacturing a transfer switch in accordance with claim 18 further comprising mechanically coupling a plurality of rotatable electric contacts to the shaft, the rotatable electric contacts configured to rotate in only a first direction along an approximately sinusoidal path.

20. A method for manufacturing a transfer switch in accordance with claim 19 further comprising providing a first quantity of paired electrical connections including a first electrical connection and a second electrical connection, and electrically coupling the rotatable electric contacts to the first electrical connection and the second electrical connection.

21. A method for manufacturing a transfer switch in accordance with claim 20 wherein said providing a first quantity of paired electrical connections comprises providing a first quantity of paired electrical connections equivalent to the first quantity of nodes and the second quantity of nodes.

22. A method for manufacturing a transfer switch in accordance with claim 14 wherein said operationally coupling a driver apparatus comprises operationally coupling a driver apparatus including a plurality of inclines and a recess positioned at an end of the inclines.

23. A method for manufacturing a transfer switch in accordance with claim 22 wherein said operationally coupling a driver apparatus including a plurality of inclines and a recess positioned at an end of at least one node of the inclines comprises operationally coupling a driver apparatus including a plurality of inclines and a recess configured to rotate the cam in only a first direction.

24. A method for manufacturing a transfer switch in accordance with claim 14 further comprising mechanically coupling a limit switch to the transfer switch, the limit switch configured to output a signal including at least one of an indication of a shaft position and an electrical output to a solenoid.

25. A method for manufacturing a transfer switch in accordance with claim 14 further comprising operationally coupling the driver apparatus and the follower apparatus offset by approximately ninety degrees.

26. A method for manufacturing a transfer switch, said method comprising:

providing a transfer switch, the transfer switch including:

a cam including:

a substantially z-shaped groove including a first quantity of nodes; and a substantially sinusoidal shaped groove including a second quantity of nodes equivalent to the first quantity of nodes and the second quantity of nodes; and operationally coupling a follower apparatus in the substantially sinusoidal shaped groove; and operationally coupling a driver apparatus in the substantially z-shaped groove, such that the driver apparatus is configured to rotate the cam in only a first direction.

* * * * *